US007490729B2

(12) United States Patent
Mattschull et al.

(10) Patent No.: US 7,490,729 B2
(45) Date of Patent: Feb. 17, 2009

(54) CENTER BUFFER COUPLING FOR RAILROAD CARS

(75) Inventors: Volker Mattschull, Braunschweig (DE); Christian Radewagen, Salzgitter (DE)

(73) Assignee: Voith Turbo Scharfenberg GmbH & Co. KG, Salzgitter-Watenstedt (DE)

( * ) Notice: Subject to any disclaimer, the term of this patent is extended or adjusted under 35 U.S.C. 154(b) by 0 days.

(21) Appl. No.: 10/990,590

(22) Filed: Nov. 17, 2004

(65) Prior Publication Data

US 2005/0145591 A1 Jul. 7, 2005

(51) Int. Cl.
*B61G 7/00* (2006.01)

(52) U.S. Cl. ..... 213/18; 213/74

(58) Field of Classification Search ..... 213/7–9, 213/18–21, 75 R, 77, 78
See application file for complete search history.

(56) References Cited

U.S. PATENT DOCUMENTS

| | | | | |
|---|---|---|---|---|
| 4,049,129 | A * | 9/1977 | Bergs | 213/4 |
| 5,472,104 | A * | 12/1995 | Domsgen | 213/4 |
| 6,685,040 | B2 * | 2/2004 | Heinisch et al. | 213/221 |
| 6,805,251 | B2 * | 10/2004 | Radewagen et al. | 213/20 |

FOREIGN PATENT DOCUMENTS

| | | | |
|---|---|---|---|
| DE | 3 632 578 | A1 | 4/1988 |
| DE | 3 228 941 | C2 | 5/1990 |
| EP | 0 358 052 | A1 | 8/1989 |
| EP | 0 640 519 | A1 | 7/1994 |
| EP | 1 129 920 | A1 | 2/2001 |
| EP | 1 112 909 | A1 | 7/2001 |
| EP | 1 312 527 | B1 | 6/2003 |

* cited by examiner

*Primary Examiner*—S. Joseph Morano
*Assistant Examiner*—Robert J McCarry, Jr.
(74) *Attorney, Agent, or Firm*—Fraser Clemens Martin & Miller LLC; J. Douglas Miller

(57) ABSTRACT

The present invention relates to a center buffer coupling for railroad cars that has a coupling head 1 and a coupling shaft 2 that holds the coupling head 1 on its front end 3, whereby the rear end 4 of the coupling shaft 2 is attached to the frame of the railroad car so that it can swivel horizontally. In the case of a crash, i.e. during the occurrence of extreme impact energies, in order to shorten the coupled couplings in such a way that the energy absorbing elements 22 on the body side dissipate the impact energy transferred between the adjacent car bodies during the impact without additional space being needed when the coupling head 1 is taken out of the force flow, according to the invention, a section 6 of the coupling shaft is formed of a first partial piece 7 and a second partial piece 8, whereby the two partial pieces 7, 8 are connected to each other by means of an overload safety device 9. In this case, the overload safety device has a first bolt 10 and at least one second bolt that responds when a specific response force is exceeded in the longitudinal and/or lateral direction of the coupling shaft, whereby the first bolt 10 and the at least one second bolt 11 are mounted in succession in the direction of the coupling shaft. Because of the design of the overload safety device 9 according to the invention, in a crash two coupled center buffer couplings are shortened by a combined linear and rotational movement of the respective coupling head 1 without this requiring space behind the attaching plane and/or behind the frame.

8 Claims, 3 Drawing Sheets

CENTER BUFFER COUPLING FOR RAILROAD CARS

CROSS-REFERENCE TO RELATED APPLICATIONS

This application claims the benefit of Application No. DE 103 55 640.0 filed on Nov. 28, 2003 in Germany.

STATEMENT REGARDING FEDERALLY SPONSORED RESEARCH OR DEVELOPMENT

Not Applicable

BACKGROUND OF THE INVENTION

The present invention relates to a center buffer coupling for railroad cars with a coupling head and a coupling shaft that holds the coupling head on its front end, the rear end of which is flange-mounted on the frame of the railroad car so that it can swivel horizontally, whereby one section of the coupling shaft is formed of a first partial piece and a second partial piece that are connected to each other by way of an overload safety device.

It is known that with a rigidly supported coupling device, impacts and vibrations that occur during driving (e.g. during braking) can lead to damage to the vehicle and/or to the coupling device itself. To prevent such damage, it is necessary to eliminate the transfer of such impacts, vibrations, etc. This is preferably achieved in that the coupling device is provided with elastic damping means, e.g. draw gears/buffing gears for absorbing such impacts.

These draw gears/buffing gears absorb traction and pressure forces up to a defined magnitude and pass the resulting forces, without damping, over the bearing mount into the vehicle subframe. In this way, each traction and impact force that occurs between the individual car bodies during normal driving operation are absorbed in the impact safety device that is generally designed to be regenerative or destructive when the operating load is exceeded. However, say during impact of the vehicle against an obstacle, it is possible that the energy absorption of the coupling provided is not adequate. This excess impact energy is then transferred directly to the vehicle subframe, which is thereby exposed to extreme stresses. On railroad cars, a case such as this leads to the danger of damage to the vehicle body.

For example, from railroad car technology [handwritten: (DE-36 32 578 A1)] arranging multi-stage energy dissipation devices in the subframe area of railroad cars is known. Generally these have a reversible energy dissipation device as the primary stage, which e.g. is integrated in the coupling shaft of a center buffer coupling in the form of a coupling spring and which will absorb impact forces that occur in driving, maneuvering and coupling operations. The coupling shaft itself can be fastened by way of an articulation and if necessary, by way of breakaway elements on the subframe of the car body.

A second, secondary energy dissipation device for absorbing impact energy resulting from bumping impacts is often mounted in the form of two side buffers on the outer edge of the face side of the respective car body. In this case, the energy dissipation devices are designed such that the conversion of the impact energy resulting from maneuvering accidents is handled in two working stages that change gradually from one to the next, whereby the first stage is integrated in the center buffer coupling and the second stage is mounted upstream of the bearing car body structure.

Another solution [handwritten: DE 3228941 C2] provides that, after the coupling-side energy dissipation device has been fully utilized, the remaining energy is dissipated to the car body-side energy absorbing elements, e.g. friction elements, over a specified breaking point in the coupling link. However, this requires that the final force, at which the coupling connection to the car body is released by the specified breaking point must be very precisely measured, which is also only possible with difficulty with the use of a friction element as well as with specified breaking connections.

The advantage of such a solution, in which during a crash the coupling is released by means of the response of a specified breaking point of the respective car body, lies in the fact that during an accident the greatest possible calculable energy dissipation can be achieved along with a predictable sequence of events, since the center buffer coupling is taken out of the flow of force when a defined force level is exceeded and thus permits the impact of the car bodies and the use of the car body-side energy absorption elements.

As a rule, however, the center buffer coupling is taken out of the force flow, in that the coupling shears off at the specified breaking points such that greater parts of the coupling take up space needed for the movement in reverse in the subframe of the vehicle. In coupling arrangements in which this space is not available, e.g. because of the immediate proximity of a bogie, it becomes impossible to implement the breakaway solution of the clutch in order to take the coupling out of the force flow if a crash occurs.

The present invention is thus based on the object of further developing a center buffer coupling of the type mentioned at the beginning, such that in the case of a crash, i.e. during the occurrence of extreme impact energies, the coupled couplings are shortened in such a way that the energy absorbing elements on the body side dissipates the impact energy transferred between the adjacent car bodies during the impact without additional space being needed behind the coupling in order for the coupling to be taken out of the force flow.

This object is achieved with a center buffer coupling for railroad cars of the type mentioned at the beginning in such a way that the overload security device has a first bolt and at least one second bolt that responds if a specified response force is exceeded in longitudinal and/or transverse direction of the coupling shaft, whereby the first bolt and the at least one second bolt are arranged in succession in axial direction of the coupling shaft.

BRIEF SUMMARY OF THE INVENTION

The solution according to the invention has a whole series of important advantages in comparison to the center buffer coupling known from railroad car technology and explained above. Because of the use of an overload safety device that responds when a specific force is exceeded, the shearing away of the coupling shaft is controlled in order to thus take the center buffer coupling out of the flow of force and thus to permit the impact of adjacent coupled car bodies, whereby the respective car-side energy absorbing elements come into play and reliably reduce the impact energy transferred. In this way, a maximum achievable, and in particular a calculable energy dissipation with a predictable sequence of events can be achieved. Because of the response of the overload safety device, the connection between the front partial piece and the rear partial piece of the coupling shaft section is released, as a result of which the coupled coupling is shortened accordingly. For this purpose, the overload safety device can have a first bolt, which is understood to be a bolt that is designed in such a way that even in the case of a crash, i.e. in a case where extreme impact energy is transferred over the center buffer coupling between adjacent car bodies, that does not break or shear off and also serves as a guide pin and connecting element. In addition, it serves as a pivot pin for swiveling away the coupling parts after the response of the overload safety device. It is also conceivable to design two bolts as shear bolts that will respond one after the other over time.

In addition, the overload safety device has at least one second bolt; the second bolt is a bolt that breaks and/or shears off when a specific force is exceeded in the longitudinal and/or transverse direction of the coupling shaft and thereby loses its function as a connecting element. In this case, the center buffer coupling according to the invention is designed in such a way that force moments are absorbed around two axes, e.g. the longitudinal and transverse axis of the coupling shaft, over the first and the second partial piece while force moments around the remaining axis, especially the vertical axis, are supported by the overload safety device, and in particular by way of the first bolt and the second bolt. The first bolt and the at least one second bolts are arranged in succession in the direction of the coupling shaft, whereby under certain circumstances a certain offset must be covered between them. In this way, the danger of premature response of the second bolt shear-off function is decreased. To do this, it is possible to design the second bolt with larger dimensions than would be the case if two bolts mounted in succession were present.

Advantageous further developments of the invention are given in the subclaims.

Thus, for example, it is provided that at least one second bolt is mounted in a hole running vertically through the two partial pieces and the first bolt is mounted in a slotted hole that runs vertically through the two partial pieces and extends in the direction of the coupling shaft, such that after response of the at least one second bolt, the two partial pieces (first and second partial piece) can move in a linear manner with respect to each other, so that they can both swivel in a horizontal plane around the first bolt and slide in a linear manner in the direction of the slotted hole. Because of the mounting of the second bolt in a hole designed as a round hole, the second bolt can absorb force moments transferred both in the longitudinal and in the transverse direction over the center buffer coupling between adjacent car bodies. Because of the mounting of the first bolt in a slotted hole, the first bolt can only absorb forces in the transverse direction over the flanks of the slotted hole. This additionally reduces the danger of premature response of the shearing-off function of the second bolt when transverse forces occur.

Because of the mounting of the first bolt in the slotted hole, it additionally assumes the function of a guide, in that after the response of the second bolt, the first bolt permits a certain longitudinal movement of the first partial piece and thus of the front part of the coupling rod. The distance of this longitudinal movement is specified by the length of the slotted hole. However, naturally other embodiments are also conceivable here. So it is possible, for example, of using a shear-off bracket, breakaway elements, friction elements or a similar device here instead of the second bolt.

In an especially advantageous implementation of the center buffer coupling according to the invention, the first bolt is mounted at a specific distance from the at least one second bolt. Because of this, the lateral forces acting between the first bolt and the at least one second bolt are adjustable, since the support width, i.e. the distance between the bolts, corresponds to the length of a lever and the respective force components acting on the individual bolts depend on the lever length, according to the lever principle. In particular, it is thus possible to keep the lateral forces acting on the first bolt and the at least one second bolt as low as possible. This—in addition to appropriate dimensioning of the second bolt—permits a very precise adjustment with respect to the response of the shear-off function.

In a preferred embodiment of the center buffer coupling according to the invention, it is provided that one of the two partial pieces is designed with a fork shape and the corresponding other partial piece is designed with a tongue shape, whereby the partial piece designed with a fork shape holds the partial piece designed with a tongue shape. The section of the coupling shaft is thus designed in two parts, whereby the fork-shaped and the tongue-shaped partial pieces are joined to each other and can be connected by means of the first bolt and the at least one second bolt, whereby the first bolt and the at least one second bolt are mounted in succession in the direction of the coupling shaft. This embodiment represents an implementation of the center buffer coupling according to the invention that is especially easy to produce and at the same time very effective. However, naturally other embodiments are also conceivable here.

In order to ensure that the impact energies that occur during normal driving and maneuvering operation and are transferred between adjacent car bodies are taken over and absorbed by the center buffer coupling, the coupling shaft is especially advantageously equipped with at least one regenerative energy dissipation element integrated in the coupling shaft. In this case, it is provided that this energy dissipation element is either a spring element or another regenerative energy dissipation system, for example a system based on gas hydraulics. A damping effect is thereby achieved by compression of the spring element or of the gas (in appropriately provided gas chambers), In a case where the energy dissipation system is based on a hydraulic function, a dynamic damping effect is also conceivable, in which the traction and pressure forces can reliably be absorbed by the throttled overflow of fluid within a chamber. Such energy dissipation elements are known from the state of the art and will not be described in more detail here. For further details, reference is made e.g. to the function principles and the advantages connected with them of the TwinStroke® buffer from the applicant.

In addition, a guide is especially preferably provided in order to guide the two partial pieces with a swivel movement in a horizontal plane around the first bolt after the response of the at least one second bolt and/or in order to guide the two partial pieces in a relative linear movement running in the direction of the slotted hole after the response of the at least one second bolt. As a possible implementation of this guide, for example, consideration could be given to slopes on at least one of the two partial pieces that provide for lateral deflection of the released first partial piece of the coupling. In this way a combined linear and rotational movement of the clutch head would be possible after the response of the overload safety device, in order to shorten the coupled coupling in the case of a crash. The advantage of this embodiment especially lies in the fact that the shortening of the coupling does not take up any space behind the connecting plane of the coupling at the car body. Naturally other embodiments are also conceivable, especially for the design of the guide.

In an especially advantageous embodiment, it is planned that the coupling shaft has a front shaft part that holds the coupling head of the center buffer coupling and a rear shaft part that is attached to the frame of the railroad car so that it can swivel horizontally, whereby both shaft parts are connected to each other by a vertical connecting bolt and can be swiveled with respect to each other around this connecting bolt, whereby the section formed of the first and second partial piece is integrated in the front shaft part and/or in the rear shaft part. By the division of the coupling shaft into a front and a rear shaft part that are connected to each other so that they can swivel, it is possible to swivel the coupling head into the vehicle profile when not in use so that danger to other vehicles in traffic due to that coupling head that would otherwise extend on the face side of the railroad car can be prevented. Because of the integration according to the invention of the section having the overload safety device in the front shaft part and/or rear shaft part, it is advantageously achieved that during response of the second bolt, the first partial piece of the coupling shaft is forced into a rotary movement upon impact with the second partial piece, which results in a buckling of the two connected couplings that is largely free of force. In the ideal case, the second bolts of both couplings respond together so that they fold together in a z-shape; but also response on only one side advantageously leads to an L-shaped folding.

In a further development of the preferred embodiment named above, it is provided that one of the two shaft parts having an upper and a lower fork shank overlaps, in the linkage area, the other shaft part in a clevis-like manner, whereby the two shaft parts can be fastened in their positions directed to each other, in which the coupling head is located outside the vehicle profile, by a locking device, forming a rigid coupling shaft, and whereby after release of the locking device the front shaft part can be swiveled into a position in which the coupling head is located within the vehicle profile.

In this process, the front shaft part can preferably be swiveled by about 120° with respect to the rear shaft part. However, angle ranges of other degrees are also possible here.

DETAILED DESCRIPTION OF THE INVENTION

Figure 1:
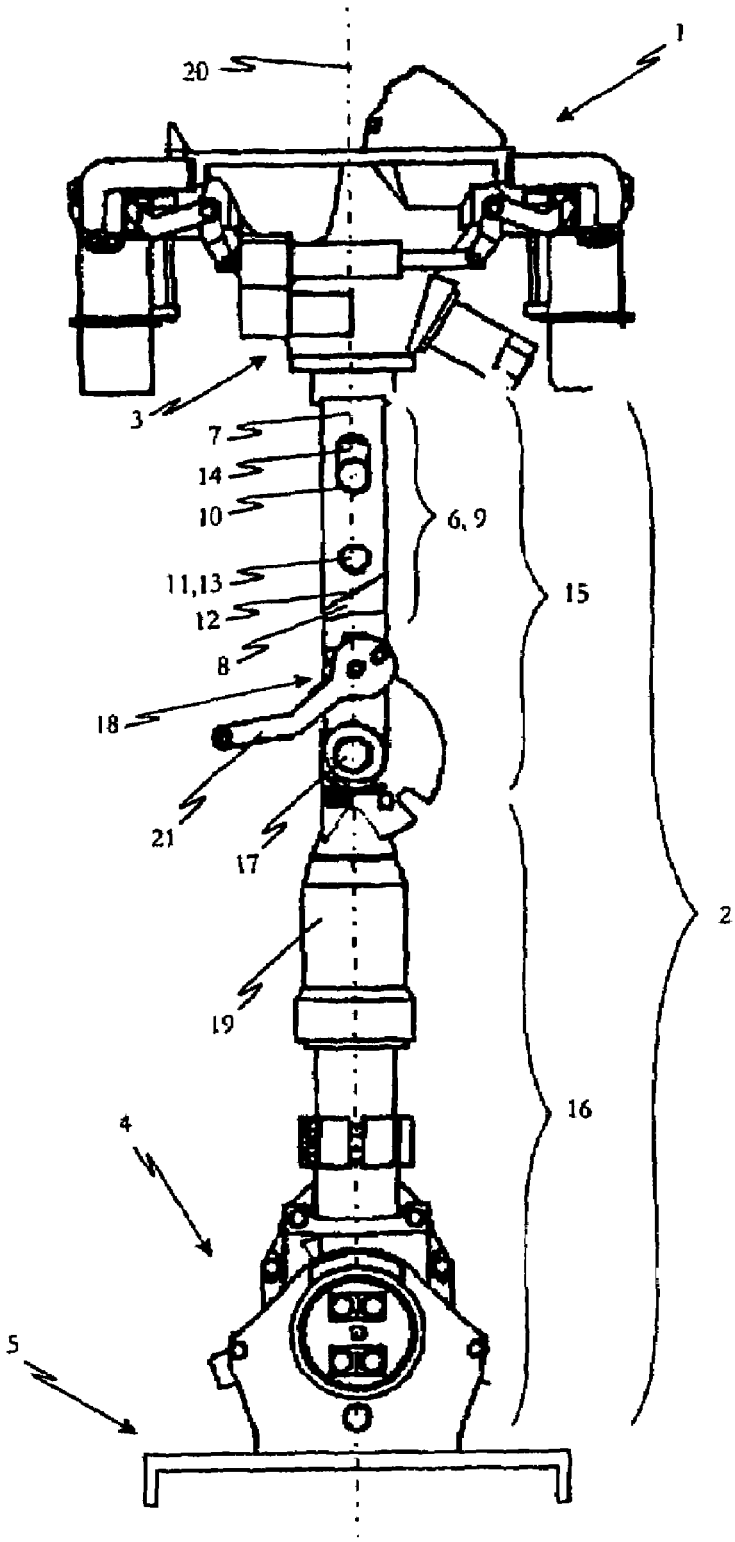
FIG. 1 shows a preferred embodiment of the center buffer coupling according to the invention in uncoupled and extended state.

FIG. 1 shows a preferred embodiment of the center buffer coupling according to the invention in uncoupled and extended state. The coupling shaft 2 of the center buffer coupling consists of a front shaft part 15 that holds the coupling head 1 on its front end 3 and a rear shaft part 16 that is hinged to the subframe and/or frame 5 of the railroad car so that it can swivel horizontally. The front shaft part 15 is designed on its free end as a clevis with upper and lower fork shanks, whereby the fork shanks hold the rear shaft part 16 between them. By means of a connecting bolt 17 between clevis and shaft part 16, the front shaft part 15 and the rear shaft part 16 are connected to each other in such a way that the front shaft part 15 can swivel horizontally with respect to the rear shaft part 16.

Figure 2:
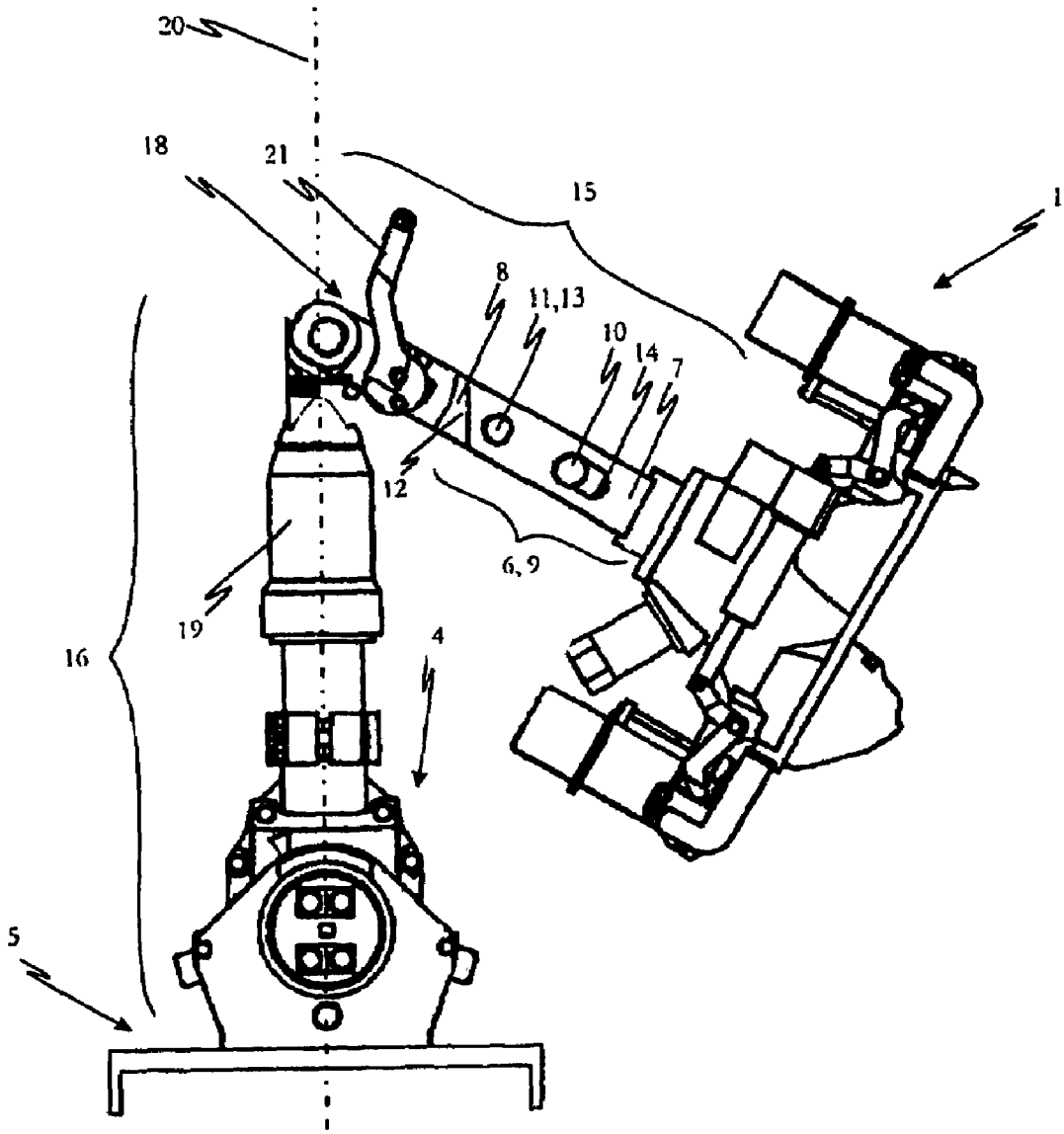
FIG. 2 shows the center buffer coupling according to FIG. 1 in uncoupled and swiveled stage.

FIG. 2 shows the center buffer coupling according to FIG. 1 in uncoupled and swiveled state. The reference number 18 designates a locking device that permits locking, free of play, of the two shaft parts 15 and 16 with each other. The release of the locking device 18 is carried out by actuating the lever 21, whereby the engagement of this locking device 18, not explained here in more detail, is released and the front shaft part 16 can be swiveled around the connecting bolt 17. In the embodiment example, a restriction [sic: presumably swivel] of the front shaft part 15 by approx. 120° with respect to the rear shaft part 16 is provided.

In addition, a regenerative energy dissipation element 19 is integrated in the rear shaft part 16. In this case, it is an energy dissipation system based on gas hydraulics, whereby a damping effect occurs by compression of the gas contained in the energy dissipation element 19. In this way, traction and pressure forces that occur in coupled state in normal driving operation are reliably accepted and absorbed. Naturally it is also possible to use an energy dissipation element 19 with friction springs here. However, the advantage of an energy dissipation system based on gas hydraulics is to be seen in that such an energy dissipation element 19 has an extremely small construction size, a reduced weight and fewer parts. In addition, advantages can be seen in increased energy absorption during load-change stress and in low procurement costs. Since the center buffer coupling shown in FIGS. 1 and 2 is not subject to any pressure stress in the version shown, the energy dissipation element 19 is present in a neutral position.

In the front shaft part 15, a shear-off section 6 is integrated which is composed essentially of a first partial piece 7 and a second partial piece 8. In this case, the first partial piece 7 is fork-shaped and the second partial piece is tongue-shaped, whereby the fork-shaped first partial piece 7 hosts the tongue-shaped second partial piece 8, in that both partial pieces are engaged with each other and connected with a first bolt 10 and a second bolt 11. The first bolt 10 and the second bolt 11 thus form the overload safety device 9 in the preferred embodiment of the center buffer coupling shown. It is provided here that the second bolt 11 is mounted in a vertical round hole 13 running through the two partial pieces 7, 8 and the first bolt 10 is mounted in a vertical slotted hole 14 that runs through the two partial pieces 7, 8 and extends in the direction of the coupling shaft 2. An important aspect of the present invention now lies in designing the overload safety device 9 in such a way that the first bolt 10 and the second bolt 11 are mounted in succession.

In operation, the force moments around the longitudinal and transverse axis of the coupling shaft are absorbed through the fork-tongue connection of the overload safety device and the force moments around the vertical axis are supported by the two bolts 10, 11. Because of the fact that the second bolt is inserted in a round hole 13, as shown, it can absorb forces both in longitudinal and in transverse direction. Because of the mounting of the first bolt 10 in the slotted hole 14, the first bolt 10 can only absorb forces in transverse direction through the flanks of the slotted hole. Because of this, the overload safety devices reacts significantly more sensitively with respect to forces that occur in the longitudinal than in the transverse direction since the absorption of forces in longitudinal direction only occurs through the second bolt 11, while forces in the transverse direction are transferred by the second bolt 11 as well as by the first bolt 10.

Because of the fact that the overload safety device 9 is significantly more robust and/or less sensitive with respect to transverse forces that occur, in comparison to longitudinal forces that occur, a situation is achieved in that the overload safety device 9 actually only responds in the case of a crash, i.e. in a case where an extreme impact that acts predominantly in longitudinal direction and/or axial direction 20 is transferred between adjacent, coupled railroad cars over the coupling shaft 2. In situations, say during coupling cars together in a curve, whereby the lateral surfaces of the coupling heads 1 to be coupled together touch first and thus whereby a bending moment occurs around the vertical axis due to the coupling impact, a premature response of the overload safety device 9 is prevented by the second bolt 11 mounted behind the first bolt 10.

The danger of premature response of the shearing-off function is also decreased in that the second bolt 11 absorbs the entire longitudinal force and is dimensioned accordingly. Because of the design (material, shape, thickness, etc.) of the second bolt 11, the response of the shearing-off function of the overload safety device 9 can be adjusted very precisely. However, it is also naturally conceivable here that instead of a single second bolt 11, as is the case in the preferred embodiment shown of the center buffer coupling, several second bolts 11 can be used, which are either grouped as desired or integrated individually in succession in the section 6.

The support width, i.e. the distance between the first bolt 10 and the second bolt 11, is preferably adapted to the respective conditions, whereby a larger support width between the two bolts 10, 11 additionally reduces the lateral forces between these due to the lever principle.

Figure 3:
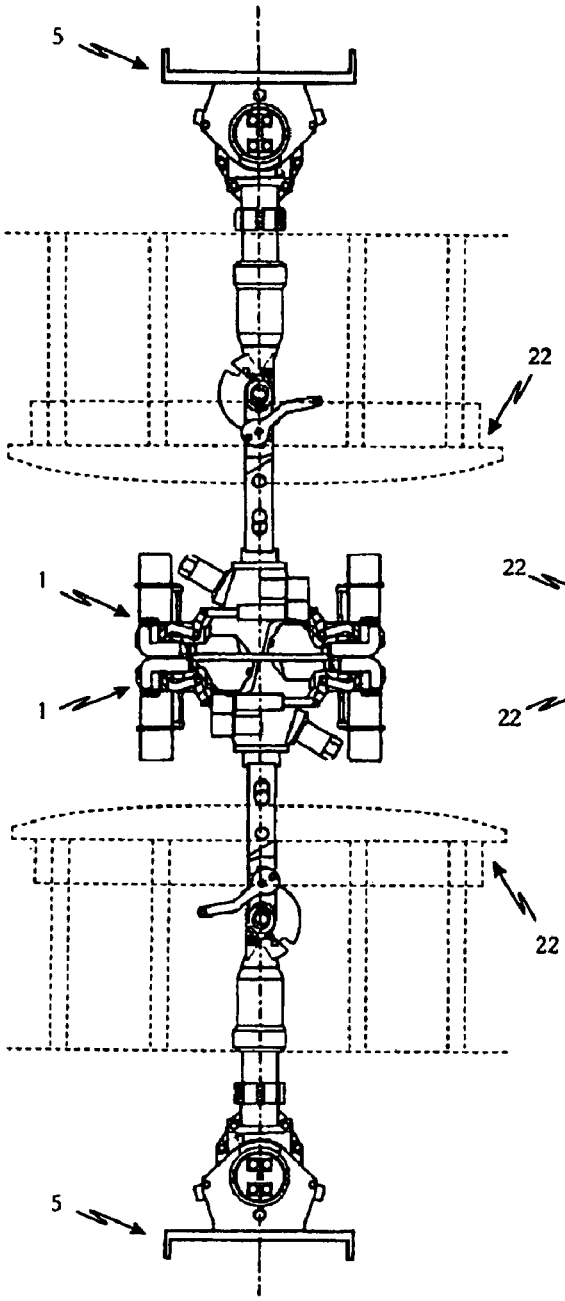
FIG. 3 shows the center buffer coupling according to FIG. 1 in coupled state before the response of the overload safety device.

FIG. 3 shows the center buffer coupling according to FIG. 1 in coupled state before the response of the overload safety device 9. From this illustration it can be seen that the energy dissipation element 19 integrated in the rear shaft part 16 is provided as a primary stage in the overall energy dissipation concept of the railroad car. This regenerative energy dissipation element serving as the primary stage is preferably mounted in the coupling shaft 2. However, it is naturally also possible to use the energy dissipation element 19 in the front shaft part 15 of the coupling shaft 2, additionally to or instead of the integration in the rear shaft part 16.

The reversible energy dissipation device 19 used as the primary stage serves to absorb the impact forces that occur in driving and maneuvering operation and transferred between the respective car bodies over the coupled center buffer coupling.

As shown in FIG. 3 in dotted lines, a second, secondary energy dissipation device is provided for absorbing impact energies resulting from excess bumping impact in the form of an impact bow 22 that is mounted on the face side of the respective car body. Naturally another force introduction element, e.g. a recessed buffer can also be used instead of the impact bow 22 to promote further impact and energy reduction.

When the front shaft part 15 and the rear shaft part 16 of the coupling shaft 2 are in their position directed to each other, the coupling head 1, as shown, is located outside the vehicle profile, which is provided by the impact bow 22. In this case it is planned that, after release of the locking device 18, the front shaft part 15 can be swiveled into a position in which the coupling head 1 is located within the vehicle profile. This swiveled position is shown in FIG. 2, but in this case, the vehicle profile and/or the impact bow 22 are not shown for the sake of clarity.

All impact elements that can optionally be equipped with other impact dissipation elements can be considered as impact bows 22.

In the case of a crash, it is now necessary to take the center buffer coupling out of the flow of force that is transferred between adjacent, coupled car bodies and thus permit the impact of the respective car bodies at their impact bow 22 and the use of the secondary energy absorption elements. The removal of the center buffer coupling from the flow of force is important in order to permit the maximum possible, and especially calculable, energy dissipation by the impact bow 22 during an accident and also a predictable sequence of events.

Figure 4:
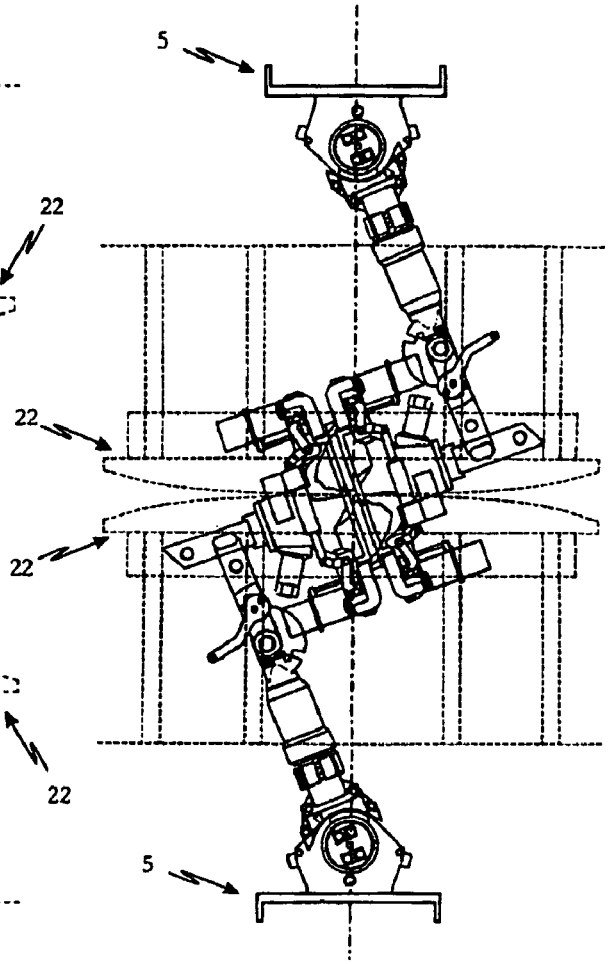
FIG. 4 shows the center buffer coupling according to FIG. 1 in coupled state after the response of the overload safety device.

FIG. 4 shows the center buffer coupling according to FIG. 1 in coupled state after response of the overload safety device 9. As can be seen, after the response of the overload safety device 9, the connection of the first and second partial pieces 7, 8 of section 6 produced by the second bolt 11 is released. After the response of the overload safety device 9, i.e. after the second bolt 11 breaks or shears off, the front shaft part 15 on the front end 3 of which coupling head 11 is fastened, glides laterally, whereby the first bolt 10 installed in the slotted hole 14 serves as the axis of rotation. In this process, guides 12 on both parts 7, 8 of the overload safety device 9, provide for a defined lateral sliding of the released first part 7 of the coupling. In the preferred embodiment shown in the figures, these guides 12 are implemented in the form of slopes.

As can also be seen in FIG. 4, the primary energy dissipation elements 19 integrated in the coupling shaft 2 of the respective center buffer couplings are in compressed state, in which the energy dissipation elements have been fully utilized. The slotted hole 14 of first bolt 10, which serve as a guide bolt after response of the overload safety device 9, permits a certain longitudinal movement of the first partial piece 7 of the coupling shaft 2. Because of the suitable geometry, upon impact with the second partial piece 8, the first partial piece 7 is forced into a rotary movement which results in a buckling, largely free of force, of the two connected couplings. In the ideal case, the second bolts 11 of the two couplings respond together so that these then fold together in a z-shape as shown in FIG. 4.

In other words, this means that due to a combined linear and rotation movement of coupling head 1, the two coupled couplings shorten in a crash without using up the space behind the connecting plane and/or behind the frame 5.

LIST OF REFERENCE CHARACTERS

1 Coupling head
2 Coupling shaft
3 Front end of the coupling shaft
4 Rear end of the coupling shaft
5 Frame
6 (Shear-off) section
7 First partial piece
8 Second partial piece
9 Overload safety device
10 First bolt
11 Second bolt
12 Guide
13 Round hole
14 Slotted hole
15 Front shaft part
16 Rear shaft part
17 Connecting bolt
18 Locking device
19 Energy dissipation element
20 Axial direction
21 Lever
22 Impact bow

What is claimed is:

1. Center buffer coupling for railroad cars with a coupling head and a coupling shaft that holds the coupling head on its front end and the rear end which is flange-mounted on the frame of the railroad car so that it can swivel horizontally, wherein:

one section of the coupling shaft is formed of a first partial piece and a second partial piece that are connected to each other by way of both a first bolt and at least one second bolt, the first bolt and the at least one second bolt constituting an overload safety device;

the at least one second bolt of said overload safety device is designed to break and/or shear off when a specific force is exceeded in the longitudinal or transverse direction of the coupling shaft;

the first bolt of said overload safety device is designed to serve as a pivot pin for swiveling the first partial piece and the second partial piece of said one section of the coupling shaft relatively to each other after the at least one second bolt is broken and/or sheared off;

the first bolt and the at least one second bolt are arranged in succession in axial direction of the coupling shaft;

the at least one second bolt is inserted in the vertical round hole running through the two partial pieces;

a slotted hole is provided in the first partial piece and the second partial piece, said slotted hole having a slot length which extends in the direction of the coupling shaft; and the first bolt is inserted in said slotted hole in such a way that, after response of the at least one second bolt, the two partial pieces can swivel with respect to each other in a horizontal plane around the first bolt and also can be slid in a linear manner in the direction of the slot length of the slotted hole.

2. Center buffer coupling according to claim 1, wherein the first bolt is mounted with a spacing having a specific distance from the at least one second bolt.

3. Center buffer coupling according to claim 1, wherein one of the two partial pieces is fork-shaped and the respective other partial piece is tongue-shaped, wherein the partial piece that is fork-shaped hosts the tongue-shaped partial piece.

4. Center buffer coupling according to claim 1, wherein at least one regenerative energy dissipation element is integrated in the coupling shaft for absorbing impact energy that is introduced into the coupling head due to the impacts that occur in normal driving operation.

5. Center buffer coupling according to claim 1, wherein the first partial piece and the second partial piece further include a guide to guide the two partial pieces with a swivel movement in a horizontal plane around the first bolt after response of the at least one second bolt and/or to guide the two partial pieces in a relative linear movement in the direction of the slot length of the slotted hole after response of the at least one second bolt.

6. Center buffer coupling according to claim 1, wherein the coupling shaft has a front shaft part holding the coupling head and a rear shaft part that is flange-mounted on the frame of the railroad car so that it can swivel horizontally, wherein both shaft parts are connected to each other by a connecting bolt and can be swiveled with respect to each other around this connecting bolt, wherein the section formed from the first and second partial pieces is integrated in the front shaft part or in the rear shaft part.

7. Center buffer coupling according to claim 6, wherein in the joint-area, one of the two shaft parts overlaps the other shaft part with at least one upper and one lower fork shank in a clevis-like manner, wherein the two shaft parts in the state where they are directed to each other, in which the coupling head extends beyond the face side of the railroad car, can be fixed with respect to each other by a locking device, forming a rigid coupling shaft and wherein the front shaft part, after loosening of the locking device, can be swiveled into a position in which the coupling head is located within the vehicle profile.

8. Center buffer coupling according to claim 7, wherein the front shaft part can be swiveled with respect to the rear shaft part.

* * * * *